US005318290A

United States Patent [19]

Sawyer

[11] Patent Number: 5,318,290

[45] Date of Patent: Jun. 7, 1994

[54] BASEBALL SWING TRAINING APPARATUS

[76] Inventor: Susan H. Sawyer, 307 Forrest Lake Dr., Texarkana, Tex. 75503

[21] Appl. No.: 992,367

[22] Filed: Dec. 17, 1992

[51] Int. Cl.[5] ..... A63B 69/40

[52] U.S. Cl. ..... 273/26 R; 273/188 A

[58] Field of Search ..... 273/26 R, 29 A, 26 C, 273/188 A

[56] References Cited

U.S. PATENT DOCUMENTS

| | | | |
|---|---|---|---|
| 2,189,613 | 2/1940 | Paulsen | 273/188 A |
| 3,372,930 | 3/1968 | Sertich | 273/26 R |
| 4,194,735 | 3/1980 | Wilson . | |
| 4,516,772 | 5/1985 | Stratton . | |
| 4,757,995 | 7/1988 | Gallagher . | |
| 5,029,869 | 7/1991 | Veasey | 273/188 A |
| 5,037,094 | 8/1991 | Johnson . | |
| 5,062,643 | 11/1991 | Bibbey | 273/188 A |

*Primary Examiner*—Theatrice Brown

*Attorney, Agent, or Firm*—Henderson & Sturm

[57] ABSTRACT

A sports swing training apparatus (10) for temporarily immobilizing a users back foot except for pivotal movement; wherein, the apparatus (10) comprises a base member (20) rotatably secured to a platform member (40); and, releasable securing means (50) operatively and detachably securing the user foot to said platform member (40) for teaching the user the proper swing technique for baseball, softball and golf.

5 Claims, 4 Drawing Sheets

BASEBALL SWING TRAINING APPARATUS

TECHNICAL FIELD

The present invention relates to the field of sports training devices in general, and in particular to a releasable foot engaging device used to instruct a baseball player the correct form while swinging a bat.

BACKGROUND ART

This invention was the subject matter of Document Disclosure Program Registration No. 287771 which was filed in the United States Patent and Trademark Office on Jul. 29, 1991.

As can be seen by reference to the following U.S. Pat. Nos. 4,757,995; 4,516,772; 4,194,735; and 5,037,094; the prior art is replete with myriad and diverse baseball hitting instructional devices which concentrate on the proper placement and stride elements incorporated into the mechanics of hitting a ball.

While all of the aforementioned prior art constructions are more than adequate for the basic purpose and function for which they have been specifically designed, these patented constructions have relied heavily on the need to provide some sort of mechanical immobilization feature which physically limits the stride length of the batters leading foot in the act of swinging the bat.

As most coaches are aware the proper mechanics of swinging a bat at a ball involve limiting the movement of the back foot of the batter to pivotal movement only as the batters lead foot moves freely in the direction of the ball.

As a consequence of the foregoing situation, there has existed a longstanding need among batting instructors for a new type of instructional apparatus that will temporarily immobilize a batters trailing foot from lateral displacement while also allowing the batters trailing foot to pivot in place, as the batter follows through with their swing; and, the provision of such a construction is a stated objective of the present invention.

Briefly stated, the baseball swing training apparatus that forms the basis of the present invention comprises in general a base unit, an anchor unit; a pivot unit; a platform unit; and, a releasable foot engaging unit.

The anchor unit is employed to secure the base unit at a desired location within the batters box. The pivot unit forms the operative engagement between the base unit and the platform unit; and, the releasable foot engaging unit provides a break-away engagement between the batters rear foot and the platform unit.

As will be explained in greater detail further on in the specification, the releasable foot engaging unit is intended to maintain the batters rear foot in the proper position during the act of swinging the bat and also to allow the batters foot and the attached platform unit to rotate in unison when the batter pivots their rear foot in accordance with the proper swing technique.

However, the releasable nature of the foot engaging unit also insures that should the batter employ an improper technique during their swing, that their trailing foot will be readily detached from contact with the platform unit to prevent injury to the batter such as a sprained ankle or the like.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
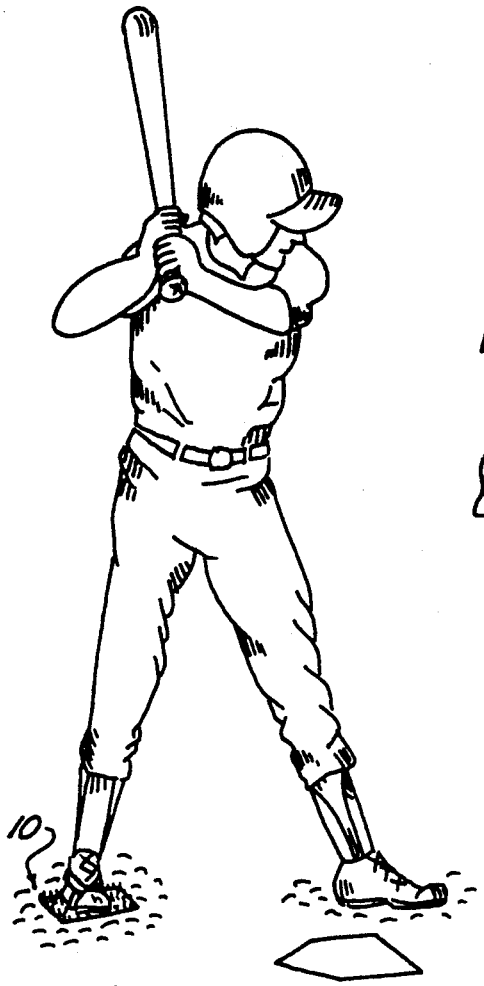
FIG. 1 is a perspective view of the baseball swing training apparatus that forms the basis of this invention in use.

As can be seen by reference to the drawings, and in particular to FIG. 1, the baseball swing training apparatus that forms the basis of the present invention is designated generally by the reference numeral (10). The apparatus (10) comprises in general: a base unit (11) an anchor unit (12); a platform unit (13); a pivot unit (14); and, a releasable foot engaging unit (15). These units will now be described in seriatim fashion.

Figure 5:
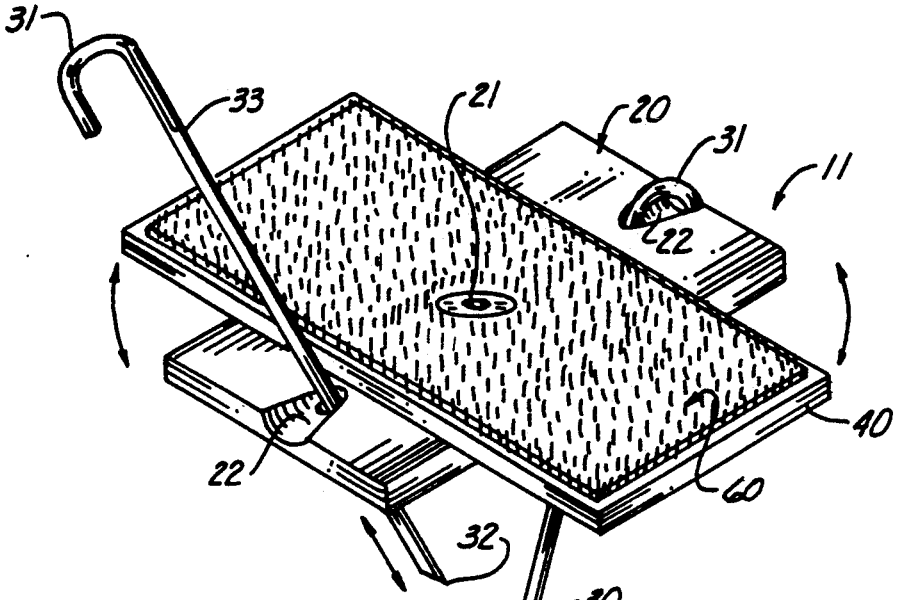
FIG. 5 is a perspective view showing the operative engagement of the anchor unit and the base unit.
Figure 6:
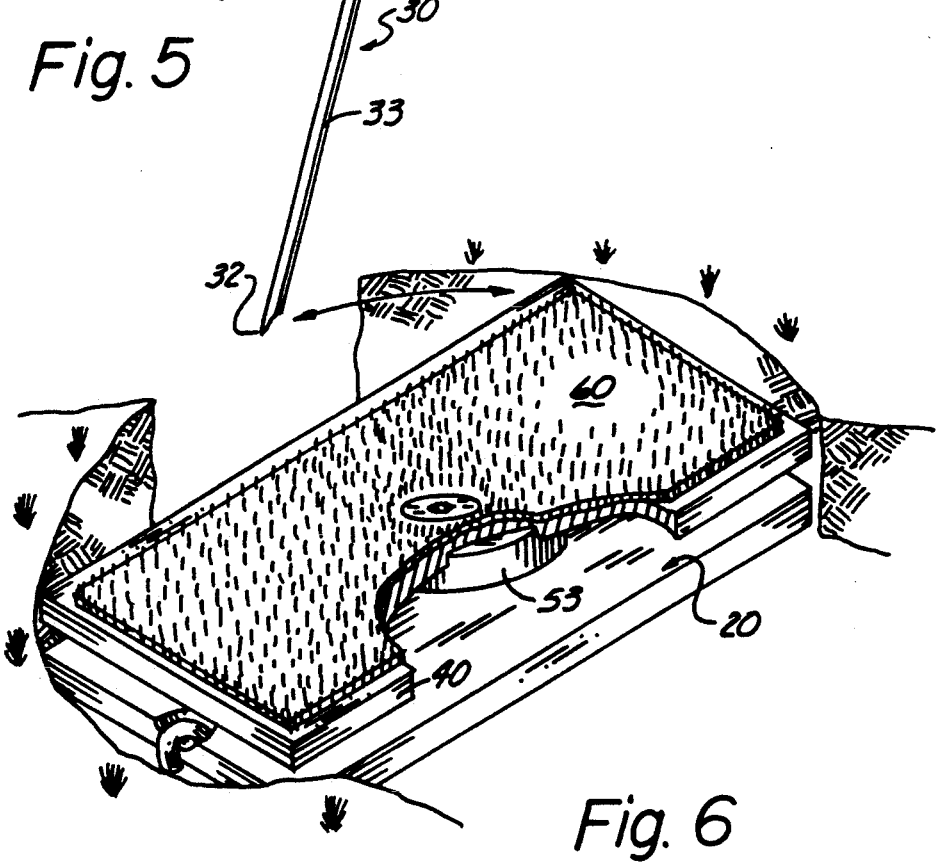
FIG. 6 is a perspective view showing the apparatus deployed in a recess.
Figure 7:
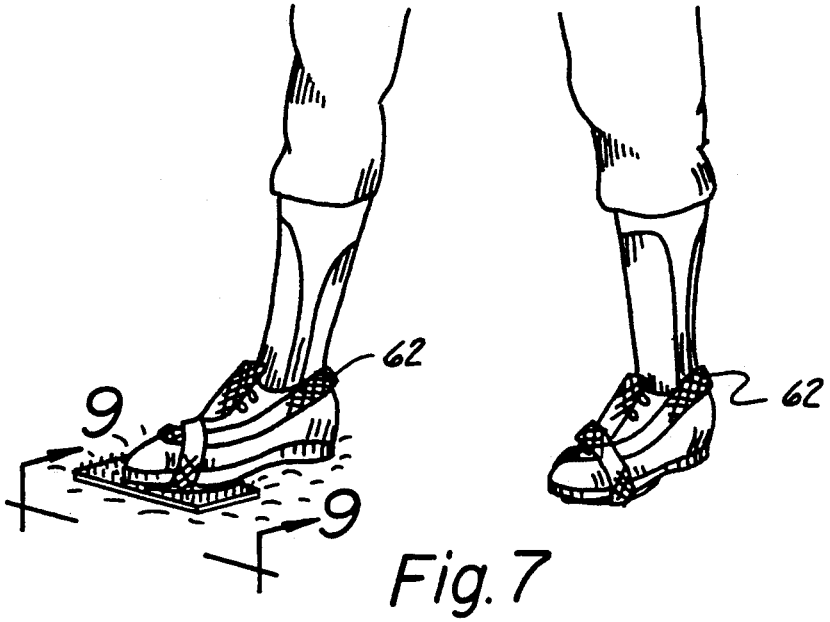
FIG. 7 is a perspective view of the apparatus and the batters feet.
Figure 8:
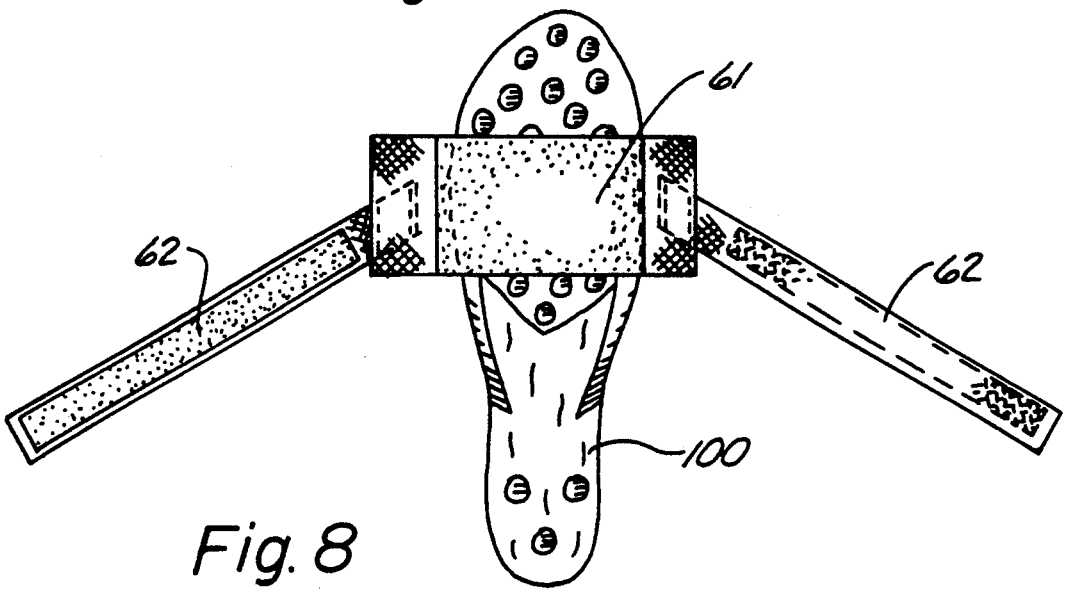
FIG. 8 is a bottom plan view of one portion of the foot engaging unit.
Figure 9:
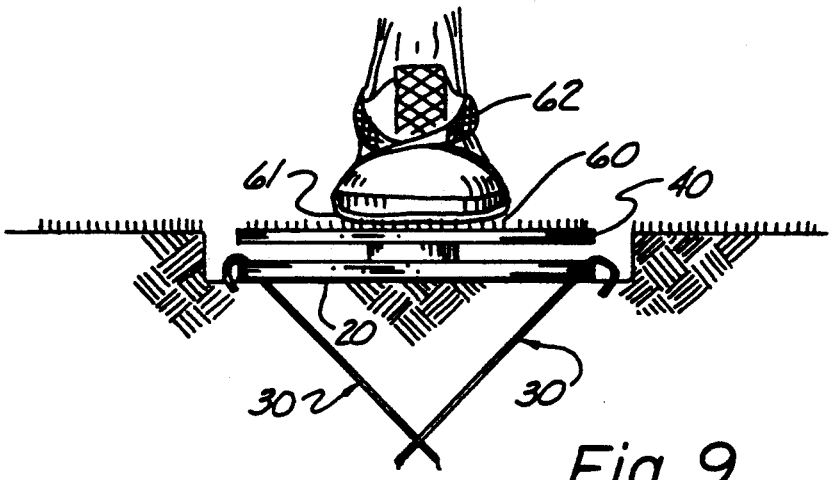
FIG. 9 is a cross-sectional view taken through line 9—9 of FIG. 7.
Figure 11:
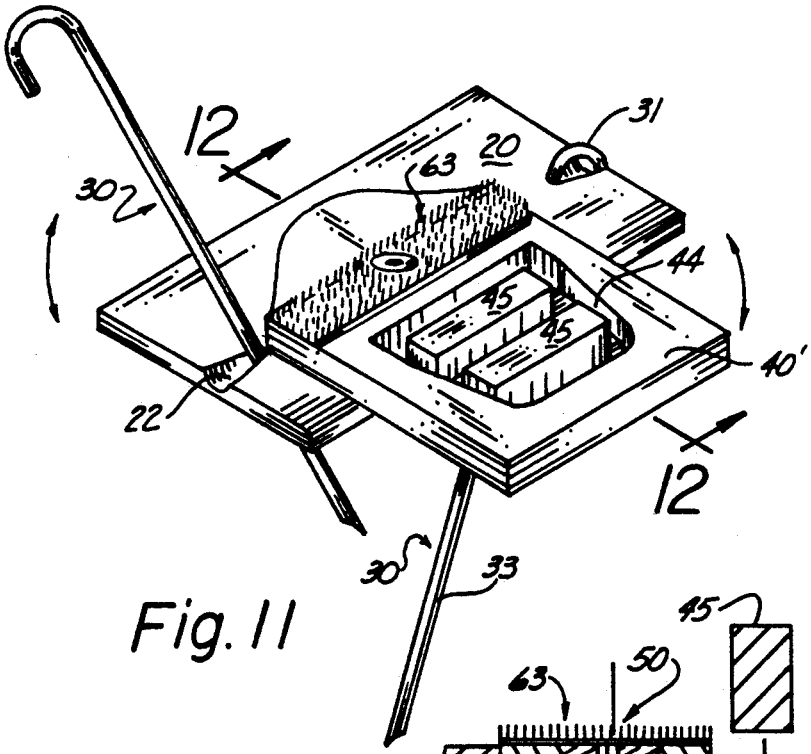
FIG. 11 is a perspective view of still another version of the preferred embodiment; and, FIG. 12 is a cross-sectional detail view of the embodiment of FIG. 11.

As shown in FIGS. 5, 6 and 11, the base unit (11) comprises a generally rectangular, rigid base member (20) provided with a central aperture (21) a plurality of recessed, angled apertures (22) whose purpose and function will be described presently.

Still referring to FIGS. 5, 6 and 11, it can be seen that the anchor unit (12) comprises a plurality of anchor stakes (30) provided with a hooked portion (31) on their upper ends, and a sharpened point (32) on their lower ends; wherein, the intermediate portion (33) of the anchor stakes (30) are dimensioned to be received in the angled apertures (22) in the base member (20) for anchoring the base member (20) to the ground in a well recognized fashion.

Figure 2:
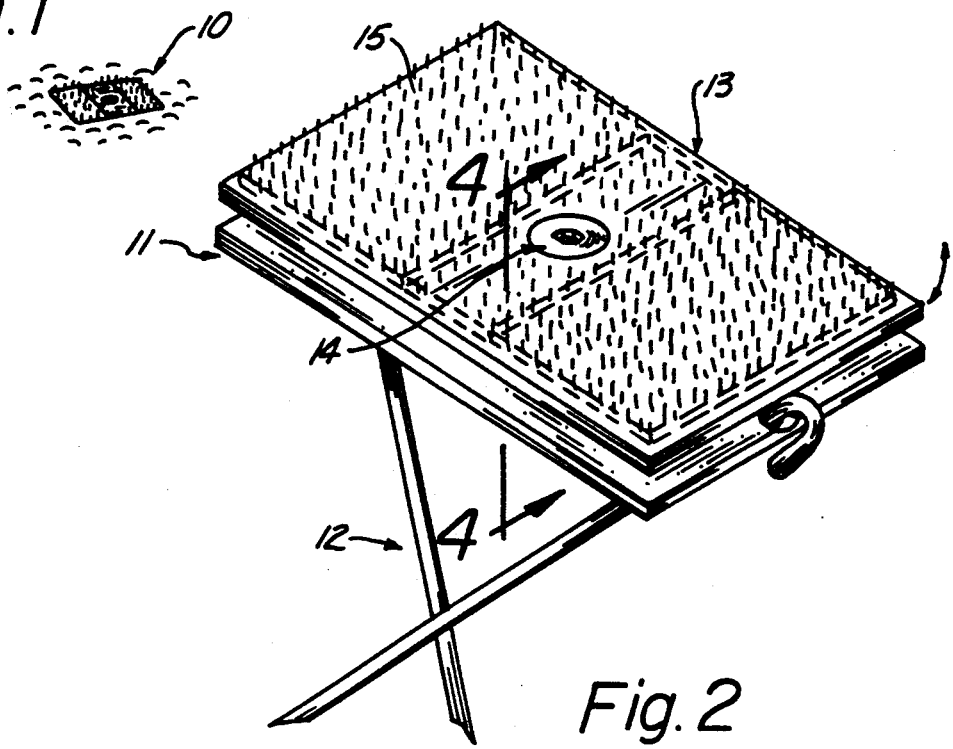
FIG. 2 is an isolated perspective view of the anchor unit; base unit; and, platform unit.

As can best be seen by reference to FIGS. 2, through 6 in the preferred embodiment of the invention, the platform unit (13) comprises a generally rigid platform member (40) provided with a tapered aperture (41) and associated recess (42) whose purpose and function will be described presently. Prior to proceeding to a description of the pivot unit (14) it should first be noted that while the platform member (40) of the preferred embodiment is depicted as having a generally rectangular configuration wherein the recessed aperture (41) is centrally disposed therein; in alternate versions of the preferred embodiment, which will be discussed in greater detail further on in the specification, other geometric configurations of the platform member (40) as well as the placement of the recessed aperture (41) may be employed.

Figure 3:
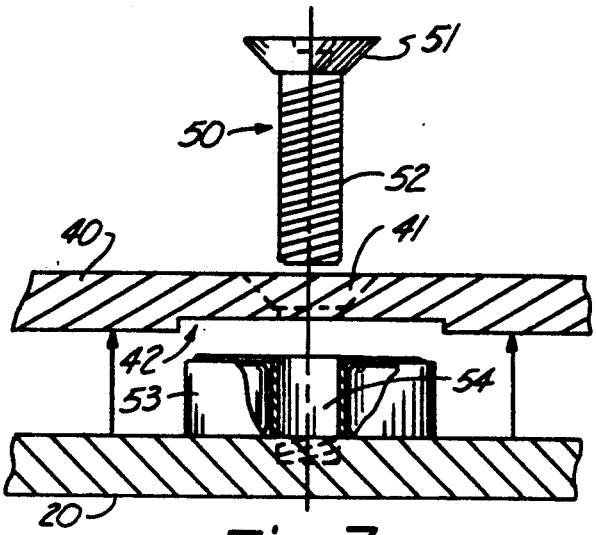
FIG. 3 is an exploded perspective view of the operative engagement between the base unit and the platform unit.
Figure 4:
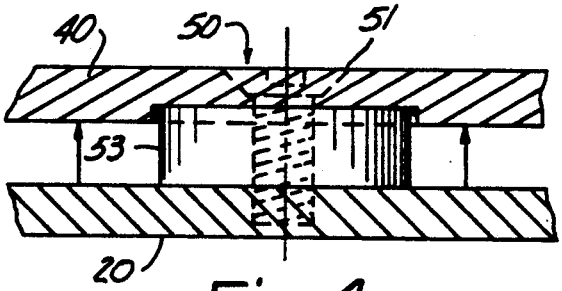
FIG. 4 depicts the assembled relationship between the base unit and the platform unit.

As shown in FIGS. 3 and 4, the pivot unit (14) forms the operative connection between the base member (20) and the platform member (40) to allow the platform member (40) to rotate freely relative to the base member (20). In addition, the pivot unit (14) comprises in general: a pivot member (50) having an enlarged tapered head (51) and a reduced diameter shaft; (52) and, a cylindrical bearing member (53) having an axial bore (54) formed therein.

Furthermore, as depicted in FIGS. 3 and 4, the enlarged tapered head (51) of the pivot member (50) is dimensioned to be received in the tapered aperture (41) in the platform member (40) to connect the pivot member (50) to the platform member (40); and, the reduced diameter shaft (52) of the pivot member (50) is dimensioned to be loosely received in the axial bore (54) in the bearing member (53).

In addition the top portion of the bearing member (53) is dimensioned to be received in the recess (42) formed in the underside of the platform member (40).

Turning now to FIGS. 5 through 8 it can be seen that the foot securing unit (15) comprises cooperating hook and loop fastening members wherein the platform member (40) is provided with a hooked or looped mat (60), and the batters foot is provided with a looped or hooked encircling arrangement, including a pad member (61) adapted to releasably engage the mat (60), and a plurality of strap elements (62) connected to the pad member (61), for securing the pad member (61) to the bottom of one of the batters shoes (100).

Once the pad member (61) has been attached via the strap elements (62) to the users foot and shoe (100), and the users foot presses down on the mat (60); the users foot will be constrained from lateral displacement relative to the platform member (40). However the users foot will still be allowed to pivot in conjunction with the platform member (40) when the user employs the proper technique with their swing; and the users foot will disengage from the platform member in the event that an improper technique is employed.

Figure 10:
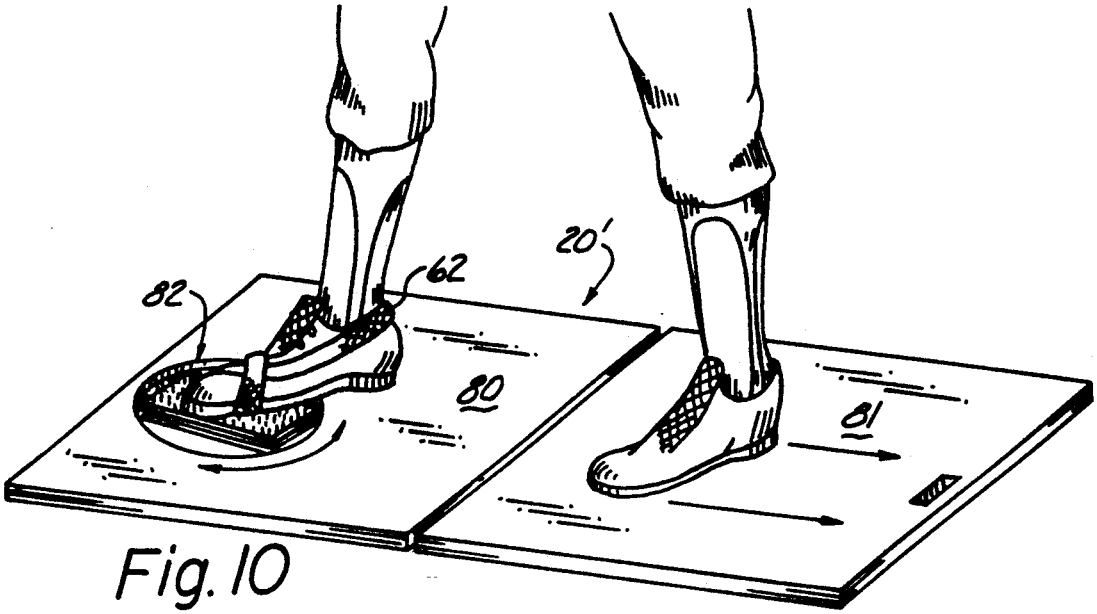
FIG. 10 is a perspective view of an alternate version of the preferred embodiment.

In one alternate version of the preferred embodiment depicted in FIG. 10, the base member (20') comprises a pair of hinged panels (80) (81) wherein one of the panels is provided with an enlarged recess (82) which receives the rest of the apparatus (10); wherein, the combined length and width of the panels approximates the dimensions of a regulation batters box.

As can also be seen by reference to FIG. 10, this particular embodiment can also be employed to practice a golf swing, since the self contained nature of the apparatus (10) within the panels (80) and (81) does not require that a circular bole by dug into the ground to place the top of the platform member (40) at ground level as suggested in FIG. 6.

Figure 12:
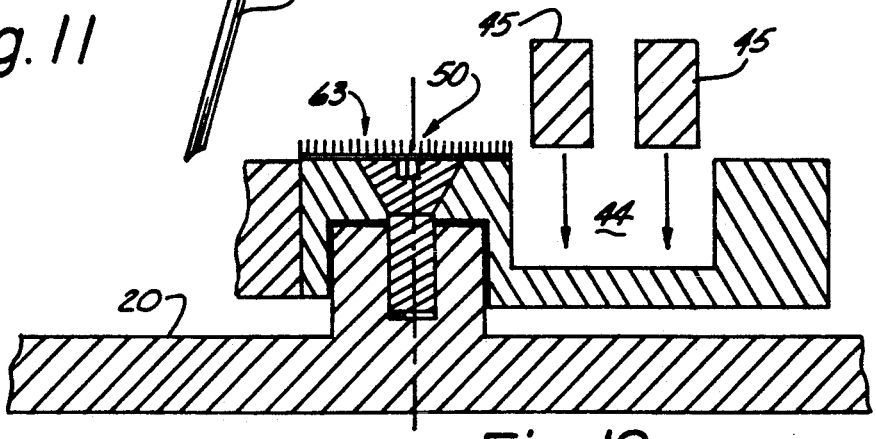

In another alternate version of the preferred embodiment depicted in FIGS. 11 and 12, the platform member (40') has an added thickness on one side of the pivot member (50) to accommodate an enlarged recess (44) dimensioned to receive a pair of shoe support members (45); wherein, the other side of the platform member (40') is truncated for reasons that will be explained presently. In addition the platform member (40') of this version is further provided with a strip member (63) which extends across the platform member (40') in the vicinity of the pivot member (50) to releasably engage the pad member (61) of the foot encircling arrangement.

In this particular version of the preferred embodiment, it is anticipated that the batter will be wearing conventional cleated baseball shoed (not shown); wherein, the front cleats will be loosely received in the enlarged recess (44) and supported by the shoe support members (45) such that only the front portion and arch of the batters cleated shoe will be in operative engagement with the platform member (40') as the batter practices their swinging technique.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A sport swing training apparatus for teaching a user wearing sports shoes the proper bat swing technique particularly with respect to the users back foot, said apparatus comprising;

a horizontally disposed base member, said base member having a vertical axis extending therefrom;

a horizontally disposed platform member connected to said base member and pivotably about said vertical axis, said platform member having a top surface;

releasable securing means, said securing means having first and second releasably engaging portions, said fit portion being attached to said top surface of said platform member and said second portion being attached to the bottom of at least one of a users sport shoe to thereby releasably restrict lateral and vertical movement between the bottom of said at least one sports shoe and the top of said platform member as the platform member pivots relative to said base member during bat swinging motion of a user;

said first and second portions being comprised of hook and loop fastener with said first portion being one part of said hook and loop fastener and said second portion being the other part of said hook and loop fastener.

said second portion being in the form of a pad member for securing said pad member to the bottom of a users ports shoe; and means for anchoring said base member to a support surface.

2. The apparatus as in claim 1; wherein, said means for anchoring is at least one stake for penetrating a support surface.

3. The apparatus as in claim 1; wherein said base member has an enlarged recess, said platform member being positioned in said recess.

4. The apparatus as in 1; wherein, said first portion is in the form of a mat.

5. The apparatus of claim 1; wherein, said strap member include a hook and loop fastener for securing said strap across the top of the users sports shoe.

* * * * *